US006213815B1

(12) United States Patent
Wu

(10) Patent No.: US 6,213,815 B1
(45) Date of Patent: Apr. 10, 2001

(54) MULTIMEDIA ELECTRIC ADAPTER

(75) Inventor: Peter Wu, Taipei (TW)

(73) Assignee: Hsing Chan Indsutrial Co., Ltd., Taipei (TW)

( * ) Notice: Subject to any disclaimer, the term of this patent is extended or adjusted under 35 U.S.C. 154(b) by 0 days.

(21) Appl. No.: 09/496,274

(22) Filed: Feb. 1, 2000

(51) Int. Cl.[7] ..... H01R 25/00

(52) U.S. Cl. ..... 439/638; 439/731; 439/502; 439/676

(58) Field of Search ..... 439/638, 639, 439/502, 676, 493, 535, 536, 731

(56) References Cited

U.S. PATENT DOCUMENTS 4,047,787 * 9/1977 Gumb et al. ..... 439/638
5,567,180 * 10/1996 Seo ..... 439/638
5,681,183 * 10/1997 Ozmura ..... 439/639
5,702,261 * 12/1997 Wang ..... 439/188

* cited by examiner

*Primary Examiner*—Hien Vu
(74) *Attorney, Agent, or Firm*—Varndell & Varndell, PLLC

(57) ABSTRACT

A multimedia electric connector includes a casing holding a circuit board, a RJ45 connector connected to the circuit board and extended out of the casing at a front side for insertion into a module jack in a wall plate, two audio signal connectors and a video signal connector respectively connected to the circuit board and extended out of a respective hole on the casing at a rear side for receiving the audio cables and video cable of a monitor for audio and video signal transmission.

2 Claims, 4 Drawing Sheets

MULTIMEDIA ELECTRIC ADAPTER

BACKGROUND AND SUMMARY OF THE INVENTION

The present invention relates to an electric adapter, and more specifically to a multimedia electric adapter, which comprises a RJ45 connector at a front side for connection to a module jack in a wall plate, two audio signal connector and one video signal connector at a rear side for receiving the audio cables and video cable of a monitor for audio and video signal transmission.

In the wall 9 of a room or office of a modern building, there is generally provided a wall plate 8 having multiple module jacks 81 for signal transmission. These module jacks 81 can not be used to receive the audio cables and video cable of a monitor for multimedia audio/video signal transmission, for example, video conference, video mail, monitoring and security, remote teaching, etc.

The present invention has been accomplished to provide a multimedia electric adapter, which connects the audio and video cables of a monitor to a module jack in a wall plate for multimedia signal transmission. According to the present invention, a multimedia electric adapter comprises a RJ45 connector connected to the circuit board and extended out of the casing at a front side for insertion into a module jack in a wall plate, two audio signal connectors and a video signal connector respectively connected to the circuit board and extended out of a respective hole on the casing at a rear side for receiving the audio cables and video cable of a monitor for audio and video signal transmission.

DETAILED DESCRIPTION OF THE PREFERRED EMBODIMENT

Figure 1:
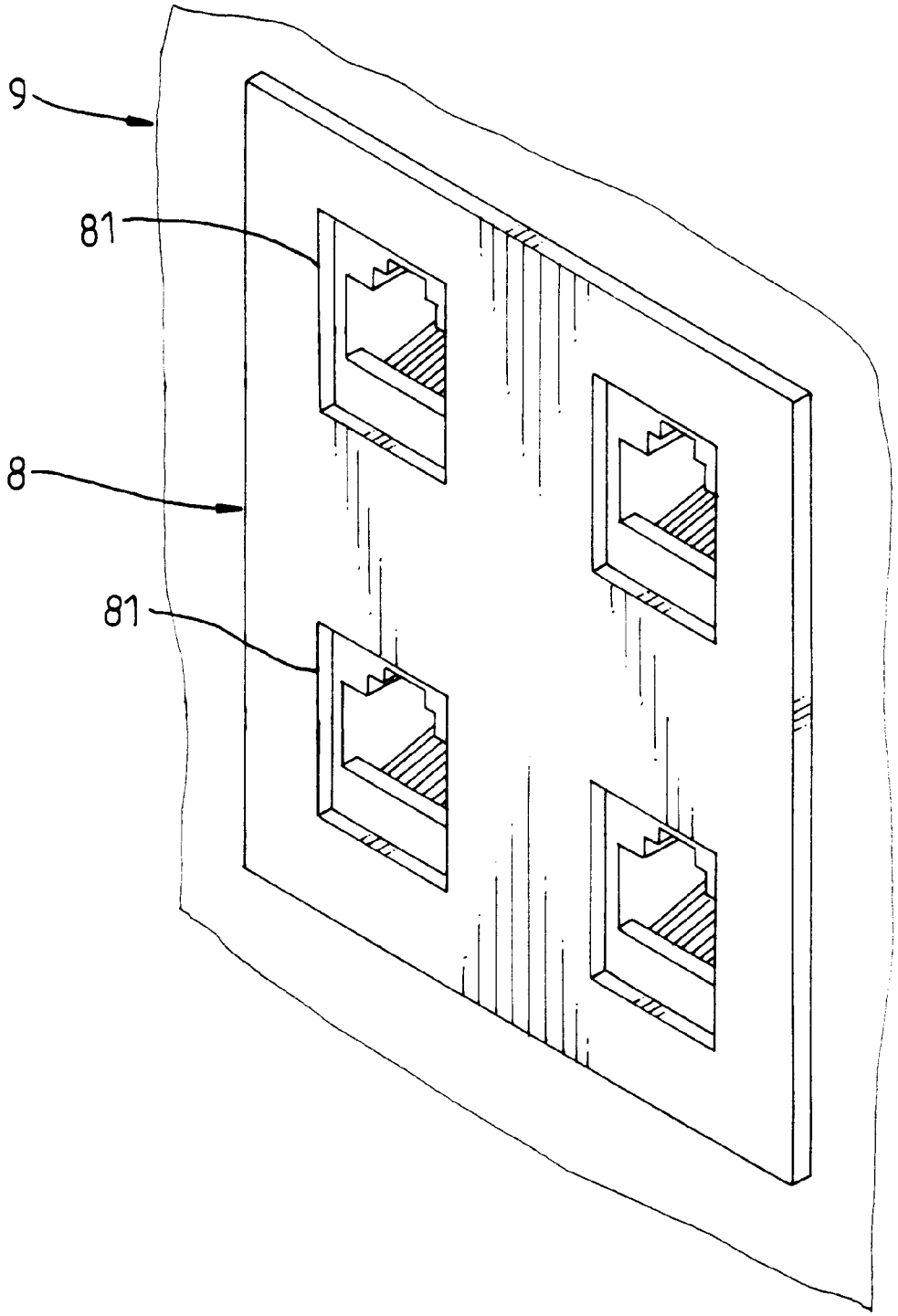
Fig. 1 PRIOR ART
FIG. 1 illustrates a regular wall plate with module jacks installed in the wall.
Figure 2:
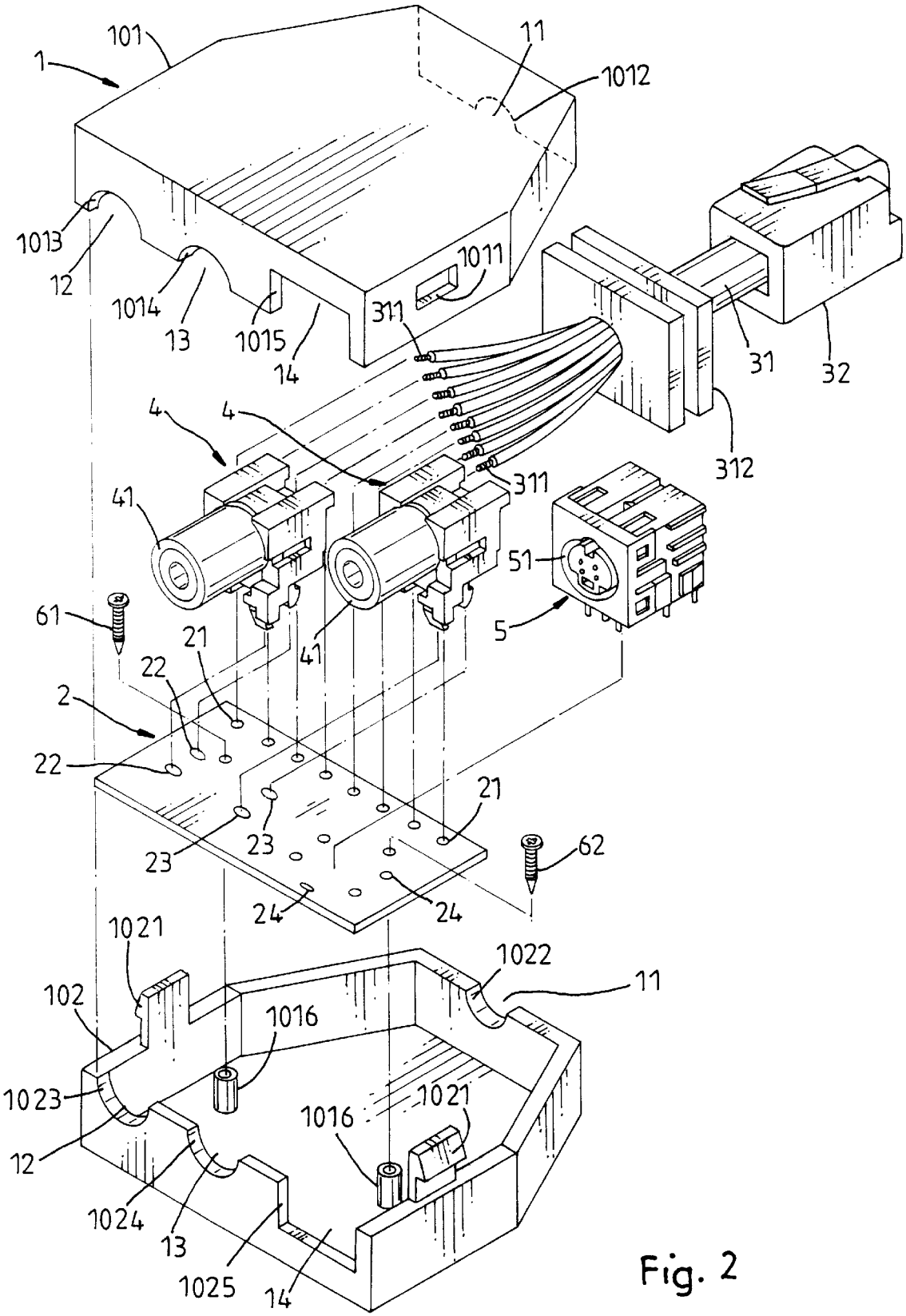
FIG. 2 is an exploded view of a multimedia electric adapter according to the present invention.
Figure 3:
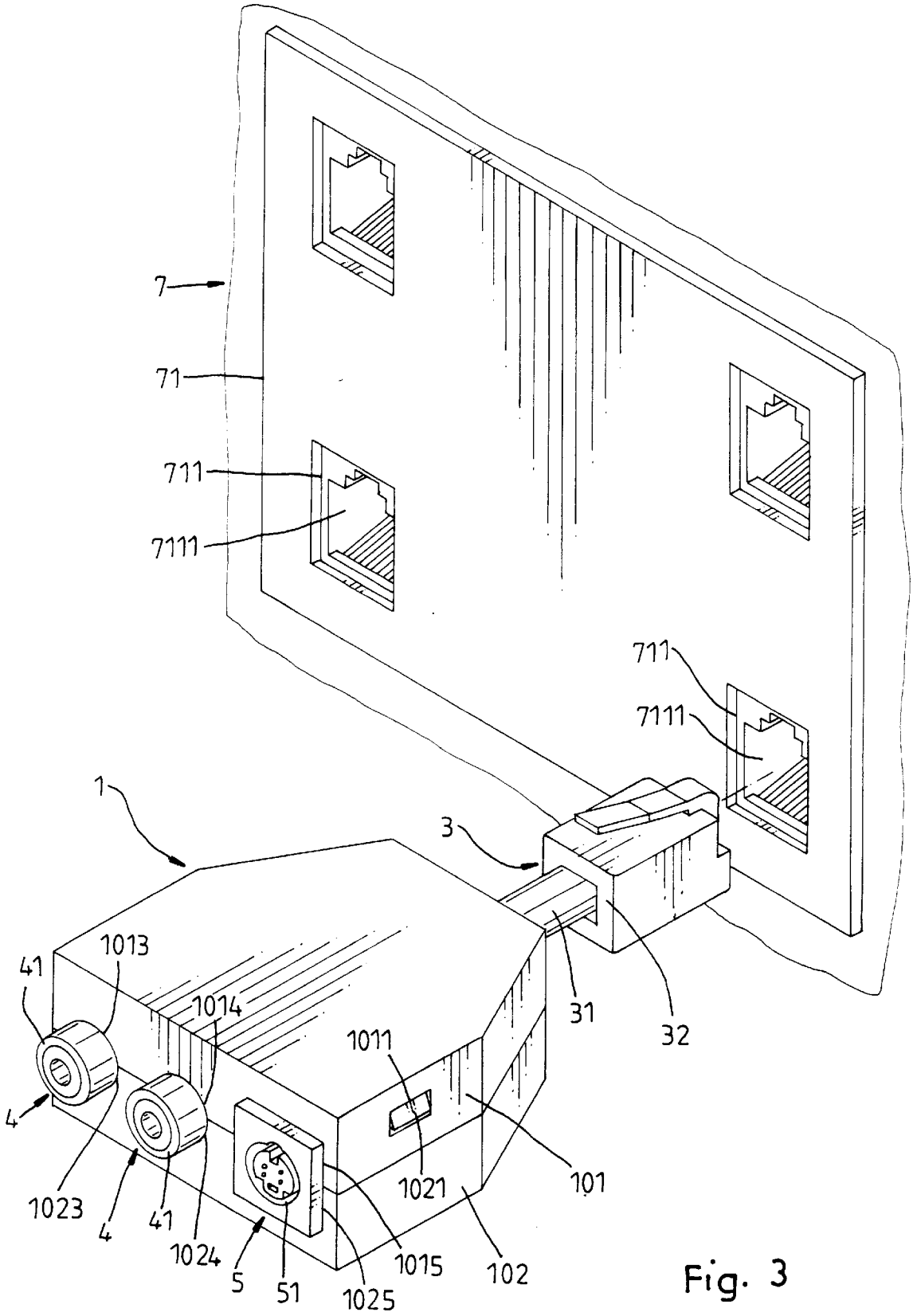
FIG. 3 is an elevational assembly view of the multimedia electric adapter according to the present invention.

Referring to FIGS. 2 and 3, a multimedia electric adapter in accordance with the present invention is generally comprised of a casing 1, a circuit board 2, a RJ45 connector 3, two audio signal connectors 4, and a video signal connector 5.

The casing 1 holds the circuit board 2 on the inside, comprising a cable hole 11 on the front sidewall thereof, and three locating holes 12, 13 and 14 on the vertical rear sidewall thereof. The circuit board 2 is fixedly fastened to the inside of the casing 1 by fastening elements, for example, screws 61 and 62, having plurality of electrically conductive contact holes 21 near the front side thereof to which conductors 311 of the signal line 31 of the RJ45 connector 3, and a plurality of electrically conductive contact holes 22, 23 and 24 near the rear side thereof to which the audio signal connectors 4 and the video signal connector 5 are fastened respectively. The RJ45 connector 3 comprises a module plug 32 for insertion into the insertion hole 7111 on a module jack 711 in a wall plate 71 in the wall 7, a signal line 31 inserted through the cable hole 11 into the inside of the casing 1, enabling the conductors 311 of the signal line 31 to be respectively welded to the electrically conductive contact holes 21 on the circuit board 2, and a stopper 312 fixedly mounted around the signal line 31 and fastened to the periphery of the cable hole 11 on the casing 1 to secure the RJ45 connector 3 to the casing 1. The signal line 31 can be made having the desired length. The audio signal connectors 4 are respectively welded to the electrically conductive contact holes 22, 23 on the circuit board 2, having a receiving side 41 extended out of the locating hole 12 or 13 on the vertical rear sidewall of the casing 1.

Figure 4:
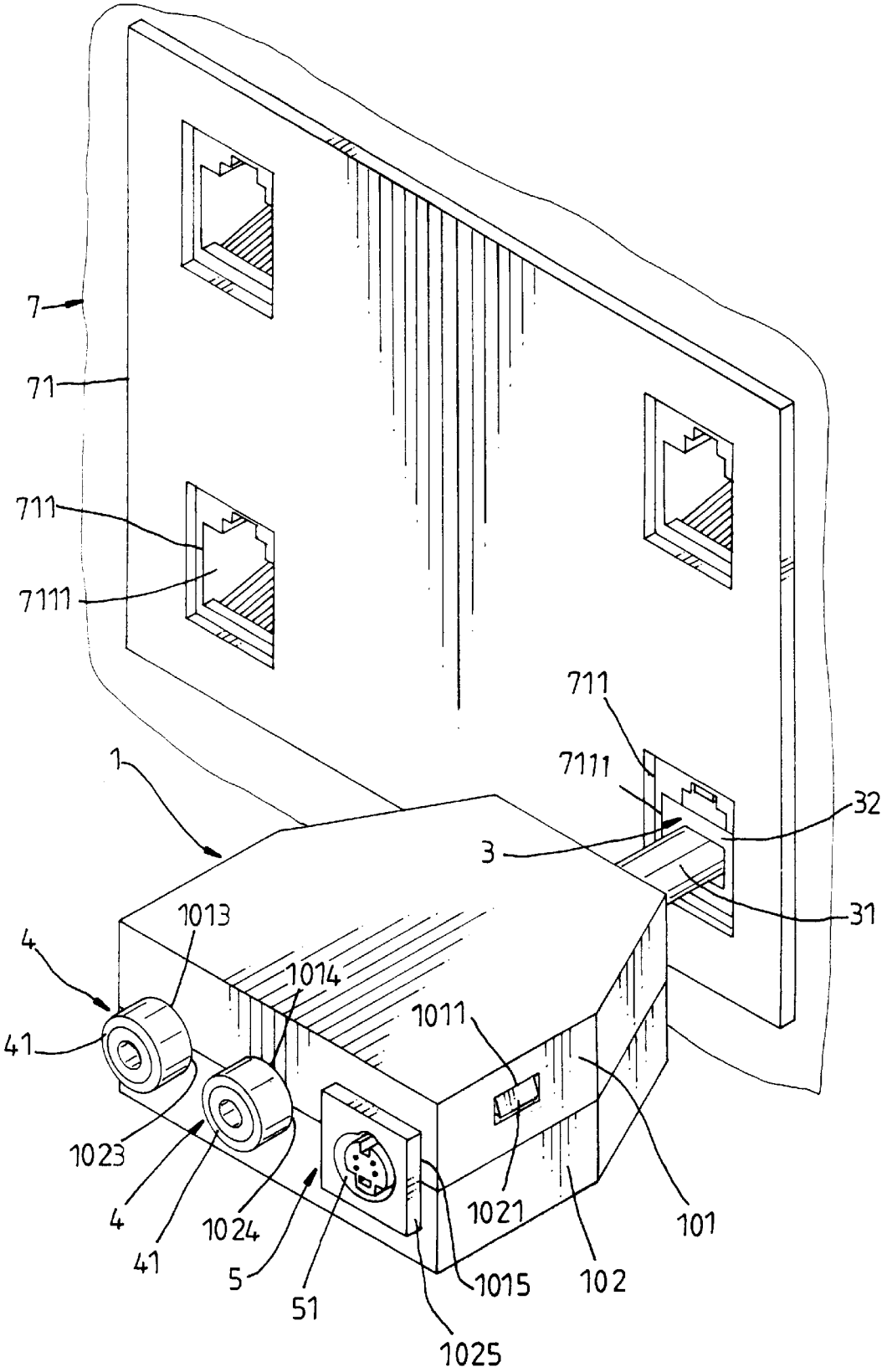
FIG. 4 is an applied view of the present invention, showing the module plug of the RJ45 connector installed in a module jack in a wall plate.

Referring to FIG. 4, when in use, the module plug 32 of the RJ45 connector 3 is inserted into the insertion hole 7111 on a module jack 711 in a wall plate 71 in the wall 7, the receiving sides 41 of the audio signal connectors 4 and the receiving side 51 of the video signal connector 5 are respectively connected to the audio cables and video cable of a monitor (not shown) for multimedia audio/video signal transmission, for example, video conference, video mail, monitoring and security, remote taching, etc.

Referring to FIGS. 2 and 3 again, the casing 1 is comprised of two symmetrical shells, namely, the top cover shell 101 and the bottom cover shell 102 fastened together. The top cover shell 101 comprises two hook holes 1011 respectively disposed on two opposite vertical lateral sidewalls thereof. The bottom cover shell 102 comprises two upright hooks 1021 respectively upwardly extended from two opposite vertical lateral sidewalls thereof and hooked in the hook holes 1011 on the top cover shell 101. The cover shells 101 and 102 each have a front notch 1012 or 1022, and a plurality of rear notches 1013, 1014 and 1015; or 1023, 1024 and 1025. When the cover shells 101 and 102 are fastened together, the front notches 1012 and 1022 form the aforesaid cable hole 11, and the rear notches 1013, 1014 and 1015; and 1023, 1024 and 1025 form the aforesaid locating holes 12, 13 and 14 respectively. Further, the bottom cover shell 102 comprises a plurality of supports 1016 to which the circuit board 2 is secured by the screws 61 and 62.

As indicated above, the present invention provides an electric adapter for connecting the audio and video cables of a monitor to a module jack in a wall plate for multimedia signal transmission. While only one embodiment of the present invention has been shown and described, it will be understood that various modification and changes could be made there unto without departing from the spirit and scope of the invention disclosed.

What is claimed is:

1. A multimedia electric connector for connecting the audio and video cables of a monitor to a module jack in a wall plate for multimedia signal transmission, comprising:

a casing, said casing comprising a cable hole disposed on a front sidewall thereof, and a first locating hole, a second locating hole and a third locating hole respectively disposed on a vertical rear sidewall thereof;

a circuit board fixedly fastened to said casing on the inside by fastening elements, said circuit board comprising a plurality of first electrically conductive contact holes near a front side thereof, and a plurality of second electrically conductive contact holes and third electrically conductive contact holes near a rear side thereof;

a RJ45 connector, said RJ45 connector comprising a module plug for insertion into the insertion hole on a module jack in a wall plate, a signal line extending from said module plug and being inserted through the cable hole of said casing into the inside of said casing, said signal line having conductors respectively welded to the first electrically conductive contact holes on said circuit boards, and a stopper fixedly mounted around said signal line and fastened to the periphery of said cable hole to secure said RJ45 connector to said casing;

two audio signal connectors respectively welded to the second electrically conductive contact holes on said circuit board, said audio signal connectors each having a receiving side respectively extended out of the first locating hole and second locating hole on the vertical rear sidewall of said casing for receiving the audio cables of the monitor; and a video signal connector welded to the third electrically conductive contact holes on said circuit board, said video signal connector having a substantially rectangular body with a receiving side extended out of the third locating hole on the vertical rear sidewall of said casing for receiving the video cable of the monitor.

2. The multimedia electric adapter of claim 1 wherein said casing comprising a top cover shell and a bottom cover shell, said top cover shell comprising a plurality of hook holes, a front notch, and a plurality of rear notches, said bottom cover shell comprising a plurality of hooks respectively hooked in the hook holes on said top cover shell, a plurality of supports, which hold said circuit board inside said casing, a front notch forming with the front notch of said top cover shell said front cable hole, and a plurality of rear notches forming with the rear notches of said top cover shell said first locating hole, said second locating hole and said third locating hole respectively.

* * * * *